US006049921A

United States Patent [19]

Erbs

[11] Patent Number: 6,049,921

[45] Date of Patent: Apr. 18, 2000

[54] OUTLET ASSEMBLY

[75] Inventor: Harold J. Erbs, Houston, Tex.

[73] Assignee: Laboratory Tops Inc., Taylor, Tex.

[21] Appl. No.: 09/118,510

[22] Filed: Jul. 17, 1998

[51] Int. Cl.[7] ..... A47K 1/04; E03C 1/182

[52] U.S. Cl. ..... 4/650

[58] Field of Search ..... 4/286–295, 650, 4/652

[56] References Cited

U.S. PATENT DOCUMENTS

| | | | |
|---|---|---|---|
| 1,008,400 | 11/1911 | Wise | 4/288 |
| 3,411,628 | 11/1968 | Mason | 4/652 X |
| 3,509,587 | 5/1970 | Fins | 4/288 |
| 3,813,708 | 6/1974 | Hamburg | 4/288 |
| 3,881,201 | 5/1975 | Richards | 4/288 X |

FOREIGN PATENT DOCUMENTS

| | | | |
|---|---|---|---|
| 0685629 | 5/1964 | Canada | 4/295 |

*Primary Examiner*—Charles E. Phillips

*Attorney, Agent, or Firm*—Beirne Maynard & Parsons, L.L.P.

[57] ABSTRACT

An outlet assembly is provided for securement into a receiving profile defined upon the bottom surface of a sink for laboratory or like usage. A sleeve is contoured such that an upper lip provides a sloping surface toward the interior of the sleeve with the lip being contoured slopingly toward the interior of the sleeve for further gravitational urging of liquid into the interior of the sleeve. The lower surface of the lip is contoured to receive a lock-nut which includes a grooveway configuration to enhance the securement of a locking-nut relative to the sink or a gasket disposed between the lock-nut and the lower face of the sink. The sleeve may include a contoured receiving profile for a filtering disk which is selectively placeable within the sleeve and which includes a series of fluid flow passageways.

3 Claims, 3 Drawing Sheets

OUTLET ASSEMBLY

BACKGROUND OF THE INVENTION (1) Field of the Invention

The invention is directed to an outlet assembly for securement into a receiving profile defined upon the bottom surface of a sink for laboratory or like usage.

(2) Brief Description of the Prior Art

Modern sink assemblies, which may be made of aluminum, plastic, hardened epoxy resin, or like known material, are frequently utilized in laboratory and hospital environments where abrasive, corrosive, acidic or other fluids requiring disposal are encountered. Such sink assemblies normally will have a circular or other profiled receiving groove in the approximate middle area of the upper face of the sink defining, or for receipt of, an elongated cylindrical sleeve outlet member which may be provided as an integral part of the sink or, alternatively, may be provided as a separate component which may be secured through the profile in the sink during assembly on location. The lower end of the sleeve is designed to receive the upper end of a plastic or similar drain line which is threadedly or otherwise permanently secured to such end of the sleeve to provide a continued passageway from the sleeve for disposal of the liquid within the sink.

It is important, because of the environment within which such sinks are utilized, for the particular sink assembly to provide fast and complete disposal of all liquid on the upper surface of the sink assembly into and through the outlet assembly to avoid or abate the adverse effects of exposure of said fluids not only to the sink surface, but also to human skin, as well.

The present invention addresses the problems associated with prior art outlet assemblies in enabling more efficient and satisfactory gravitational drainage of fluids within the sink.

SUMMARY OF THE INVENTION

Figure 1:
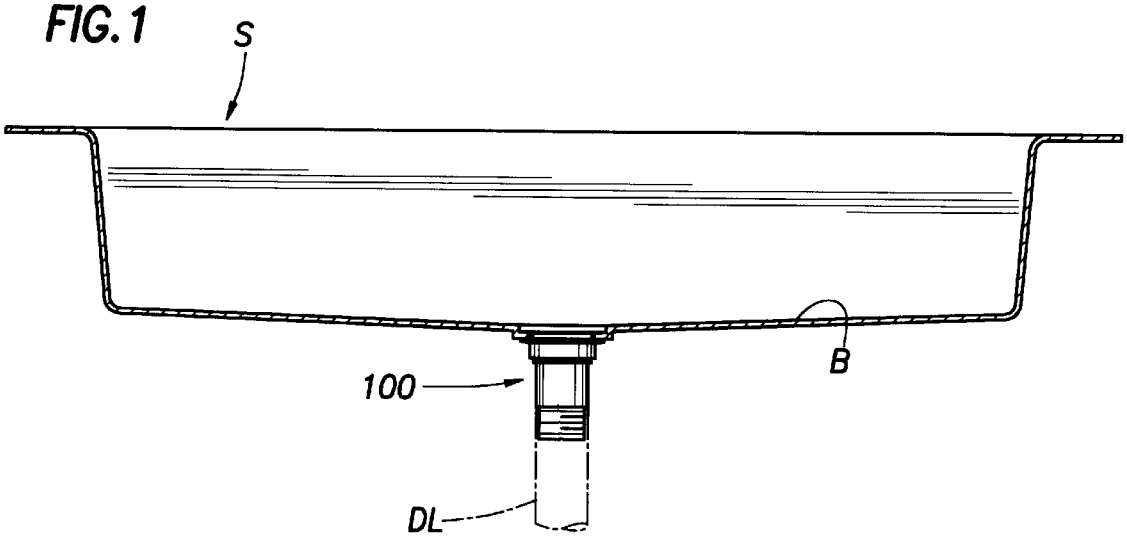
FIG. 1 is a cross-sectional view of a typical laboratory sink including the outlet assembly of the present invention.
Figure 2:
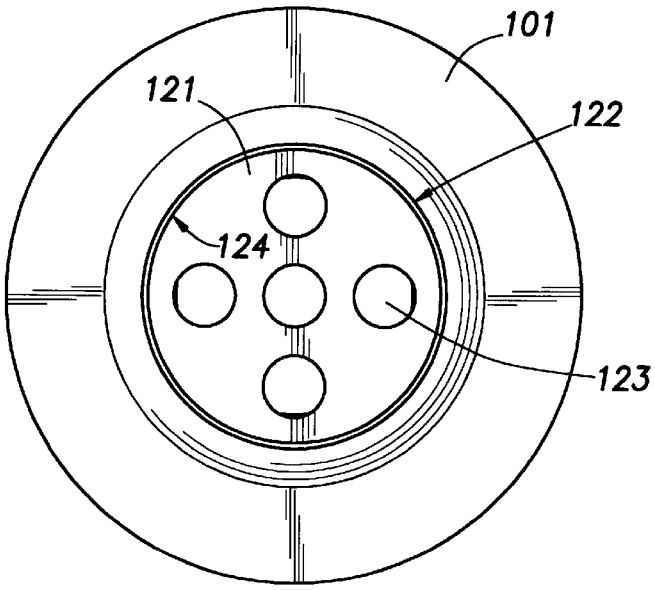
FIG. 2 is a view of the device of FIG. 3 looking downwardly therein.

The present invention provides an outlet assembly for securement into a receiving profile which is defined upon the bottom surface of a sink used in laboratory or the like environments. The outlet assembly includes an elongated cylindrical sleeve. The cylindrical sleeve has upper and lower ends and defines a continuous inner wall extending therethrough from approximate the upper end to the lower end. A lip with top and bottom sides is provided around the upper end of the sleeve. The lip projects outwardly from and radially around the upper end of the sleeve. The top side of the lip defines a smooth surface which has an outer edge which is in substantial horizontal alignment with the bottom surface of the sink when the outlet assembly is secured within the sink. The top side of the smooth upper surface of the lip also includes an inwardly curved portion extending through the upper end of the sleeve and providing a part of the continuous inner wall within the cylindrical sleeve. The smooth upper surface of the top side of the lip slopes concavely from the outer edge through the inwardly curved portion to permit liquid within the sink and through the sleeve to be gravitationally urged into the upper end of the sleeve.

The bottom side of the lip of the outlet assembly includes a tapered portion extending exteriorally around the upper end of the sleeve for center alignment of the assembly into the receiving profile.

The exterior of the sleeve is provided with threads for inter-engagement with companion threads on a lock-nut. The lock-nut is positionable by hand around the sleeve for securing the assembly to the sink, and the top surface of the lock-nut includes a series of circular grooveways extending between companion upwardly projecting walls having an apex tip formed on the outermost surface. The walls slope outwardly and downwardly therefrom to the respective grooveway. A sealing elastomeric gasket may be disposed around the exterior of the sleeve and above the lock-nut, such that the grooveways and the projecting walls are immeshable into the gasket upon securement of the assembly into the sink. Alternatively, a sealant, such as an epoxy or silicone material may be applied to the top of the lock-nut which will fill the grooveways may be used in place of or in combination with the gasket.

A lock-nut which is contemplated for use with the sink assembly of the present invention includes an outwardly extending interiorally defined circumferentially extending shoulder on one side of one of the projecting walls around the interior of the lock-nut for engagement with the taper to thereby lock the lock-nut onto the sleeve in resistance to movements therebetween in one direction.

The outlet assembly may also include a circular filter disk which is placeable on a shouldered profile within the interior of the sleeve. The disk defines a series of fluid flow passageways therethrough and includes an inwardly and downwardly sloping or tapered exterior surface therearound for conforming alignment within the shouldered profile when the disk is placed within the sleeve. This profile conforms to a companion profile defined as part of the inner wall of the elongated cylindrical sleeve at a desired pre-selected vertical point interiorally around the sleeve.

DESCRIPTION OF THE PREFERRED EMBODIMENTS

Now with first reference to FIG. 1 a sink S with a smooth bottom surface B is shown in cross-sectional configuration, to which is affixed the outlet assembly 100, which, in turn, is threadedly secured at its lower-most end to a drain line DL (shown in dotted-line configuration). The outlet assembly 100 is shown in more detail in FIGS. 3 and 4.

Figure 3:
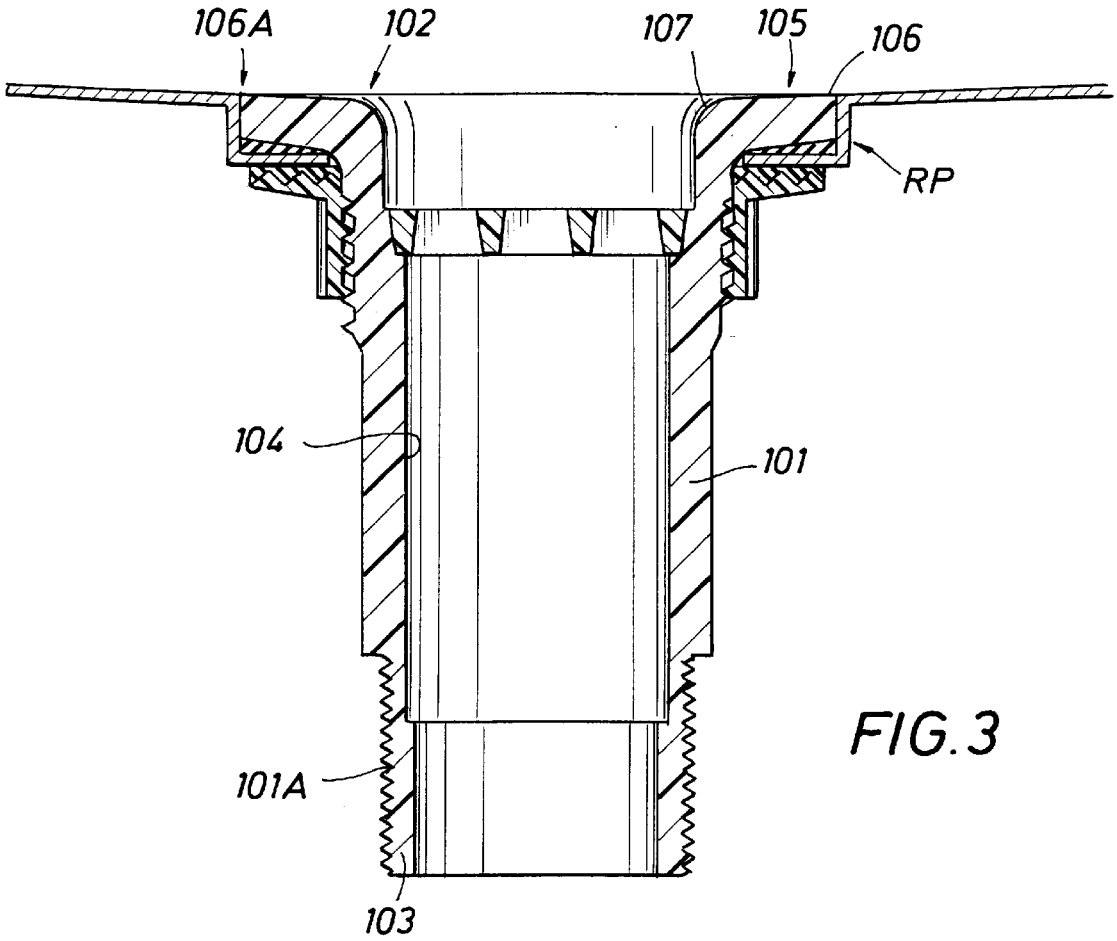
FIG. 3 is an enlarged cross-sectional view of the outlet assembly of the present invention with the filtering disk in place.

Referring now to FIG. 3, the outlet assembly 100 includes an elongated cylindrical sleeve 101 having threads 101*a* at its lower-most end circumferentially scribed around the exterior thereof for receipt of the drain line DL. The sleeve 101 includes an upper end 102 and a lower end 103, as well as a continuous inner smooth wall 104. The upper end 102 is defined by an outwardly protruding lip member 105 having a top side or surface 106 which has a curved portion 107 extending inwardly and forming the upper portion, or beginning, of the continuous inner wall 104 of the elongated cylindrical sleeve 101.

Figure 4:
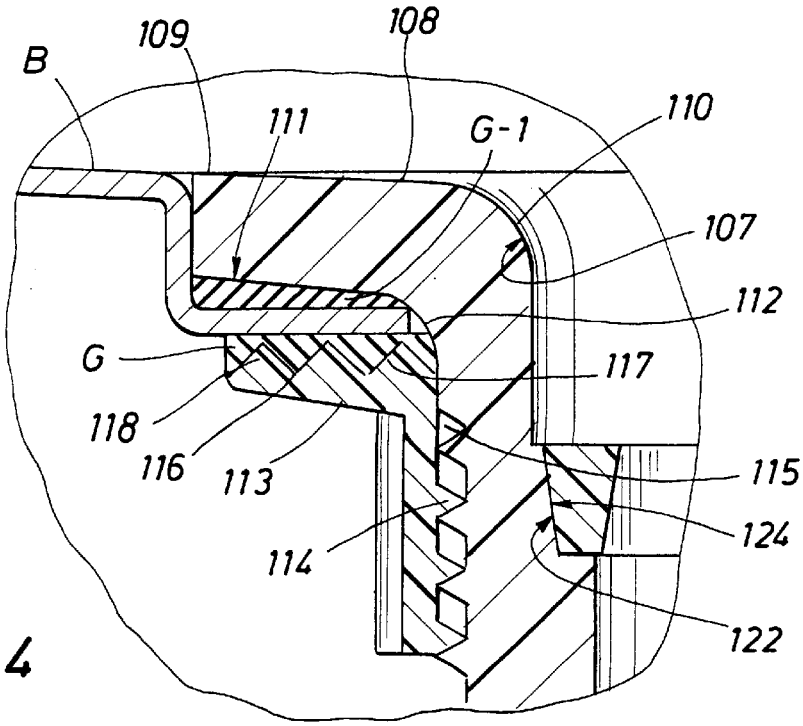
FIG. 4 is an enlargement of a portion of the outlet assembly as it is engaged by the lock-nut within the receiving profile of the sink.

Now referring to FIG. 4, the top side of the lip 106 has a smooth surface 108 which, when the apparatus 100 is in place within the sink S has its outer edge 109 in substantial horizontal alignment with the bottom surface B of the sink S. The smooth surface 108 extends from the outer edge 109 lowerly or downwardly, into a concave-shaped slope configuration 110 within a curve 107. The smooth surface 108 thus slopes inwardly toward the curved portion 107 and the continuous wall 104 from the outer edge 109 and out of substantially complete horizontal alignment relative to the bottom surface B of the sink S.

The lip 105 also includes a bottom side 111 which extends to a circularly extending taper profile 112 for locking engagement with a lock-nut 113, as described below. Securing threads 114 are provided for mating inter-engagement with sleeve threads 115 defined around the upper exterior of the sleeve 101. The lock-nut 113 includes a series of radially defined grooveways 116 on the upper face thereof, each grooveway 116 being defined between a series of upwardly extending grooveway wall members 117 which, in turn, terminate in an apex tip 118. When a sealing gasket, such as gasket G-1, which may be of a thin elastomer, plastic, or the like, is placed around the exterior of the sleeve 101 and the sink S, the combined grooveway wall 117 and grooveway 116 combination are bitingly urged into the gasket G-1 to provide enhanced sealing between the lock-nut 113 and the lower face of the bottom surface B of the sink S. An epoxy or silicone sealant may be used in place of or in combination with the gasket. However, it is not necessary in all instances that a gasket G-1 be provided, and in such cases, the grooveway wall 117 and grooveway 116 configuration still provides additional securement of the lock-nut 113 relative to the lower face of the bottom surface B of the sink S.

Another gasket G, similar in construction as the gasket G-1, may be provided as a seal between the bottom side 111 of the lip 105 and a receiving profile RP defined within the bottom surface B of the sink S for additional sealing engagement.

While the taper 112 is not required for more effective drainage, its incorporation enables better alignment of the apparatus 100 when it is installed in the sink S, since the taper configuration 112 has a tendency to center the apparatus within the receiving profile RP of the sink S.

Figure 5:
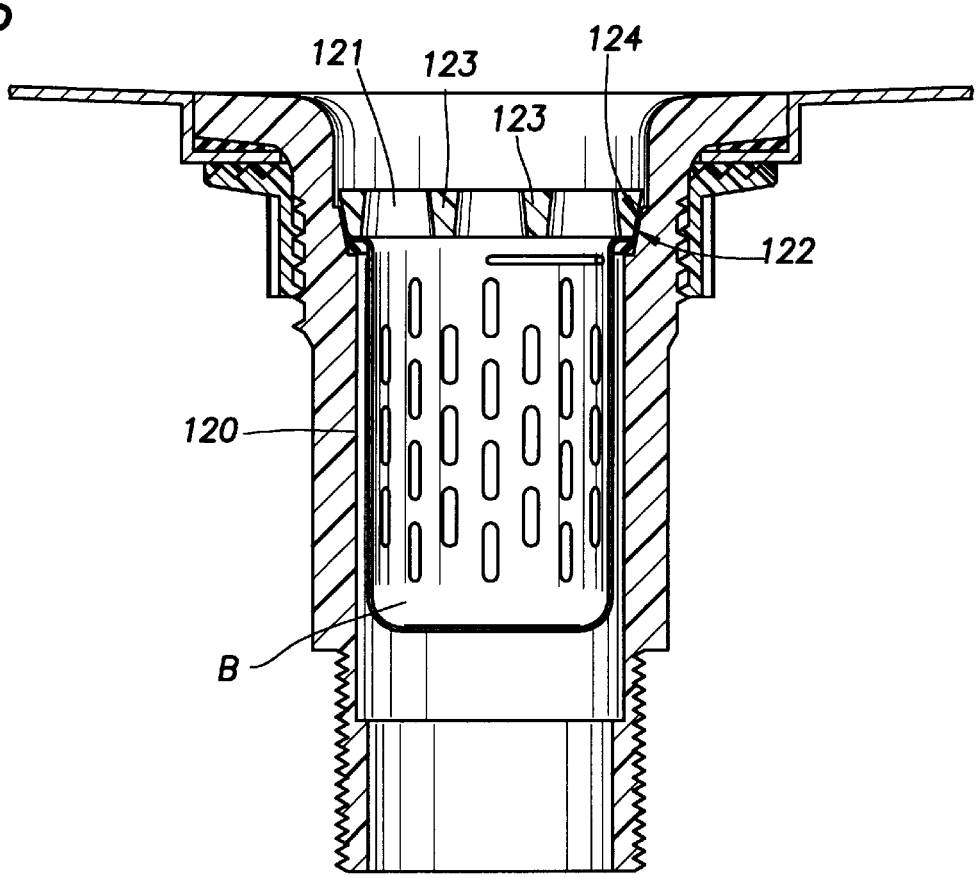
FIG. 5 is a cross-sectional view of the outlet assembly within the sink and similar to the view shown in FIG. 3.

FIG. 5 illustrates the apparatus 100 with a removable basket B installed therein for separation of solids and semi-solids from the fluid disposed through the apparatus 100. The basket B may be of the unique type as disclosed in co-pending application Ser. No. 09/036,193 filed Mar. 7, 1998, and entitled "Liquid Drain Apparatus Incorporable Within a Counter Top." However, other basket assemblies of differing construction can conceivably be incorporated within the apparatus 100.

On the inner wall 120 of the apparatus 100 is defined an outwardly and upwardly shouldered sloping profile 122 for selective receipt of a filter disk 121 which is circular in configuration and includes a series of fluid passageways 123 disposed therethrough. Around the exterior of the filter disk 121 is provided an inwardly and downwardly sloping exterior surface 124, the slope of such surface 124 being companionly defined relative to the shouldered sloping profile 122 of the inner wall 120. The configuration of the slopes or tapers 122/124 relative to one another enable the filter disk 121 to be placed into the interior of the apparatus 100 such that fluid passing through the fluid passageways 123 and upon the filter disk 121 urges the filter disk 121 toward the profile 122, such that "chatter," i.e., combined rotational or partial rotational and vertical movements, of the disk 121 are abated.

While the disk 121 is not locked into place relative to the inner wall 120 along the profile 122, and may be withdrawn from within the apparatus 100 by hand or by insertion of, for example, a thin wire, rod or the like inserted through the passageway 123, the disk 121 is firmly placed within the inner wall 120 due to the combination of the alignment of the surfaces 122 and 124 and downward force applied to the upper surface of the filter disk 121 when fluid is disposed thereon and through the passageways 123. When the sink S is properly and completely drained, the filter disk 121 is easily removable because of the termination of downwardly urged force or pressure upon the upper face of the disk 121. The basket B may then either be withdrawn from or introduced into the interior of the apparatus 100, as required.

Figure 6:
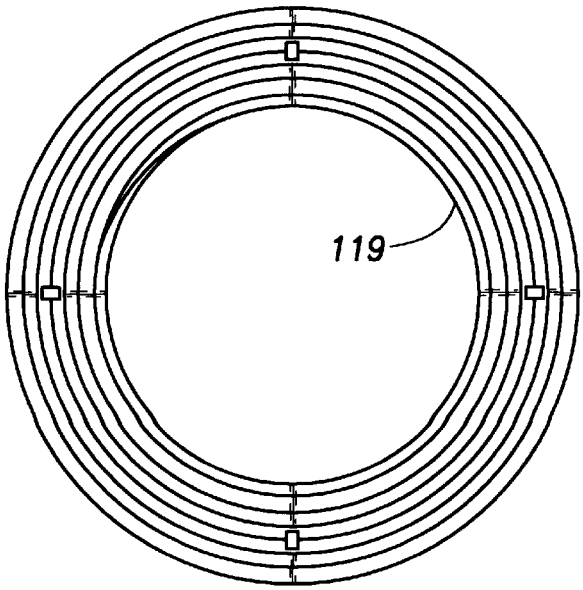
FIG. 6 is a view of the lock-nut of FIG. 4 looking downwardly upon the upper surface thereof illustrating the combined grooveway/wall configuration and the inner locking shoulder.

Now referring to FIG. 6, a contoured shoulder 119 is defined interiorally on lock-nut 113 and may be a continuing profile of the inner-most grooveway 116 extending from the inner-most grooveway wall 117. When the lock-nut 113 is desired to be secured relative to the lower face or bottom side 111 of the lip 105, the shoulder 119 will come into contact with a lower portion of the taper 112 such that resistance to movements in one direction of the lock-nut 113 is provided, further securing the lock-nut 113 in place.

OPERATION

When it is desired to incorporate the outlet assembly 100 into the sink S, the elongated cylindrical sleeve 101 is placed into the receiving profile 103 subsequent to placement within the profile RP of a gasket G. The lower end 103 of the sleeve 101 passes through the opening in the receiving profile RP. The taper 112 assists in centering the apparatus 100 within the receiving profile RP. Thereafter, a gasket G-1 may be placed around the upper end of the lock-nut 113 for contacting engagement with the apex tip 118 of the respective grooveway walls 117, or a silicone or epoxy sealant may be applied by hand to the top surface of the lock-nut 113 to fill the grooveways. The lock-nut 113 then is placed around the exterior of the elongated cylindrical sleeve 101 by inter-engagement of threads 114 on the lock-nut 113 and threads 115 on the sleeve 101. Continued rotation of the lock-nut 113 relative to the sleeve 101 will cause the upper surface of the gasket G-1 to come into contact with the lower face of the receiving profile RP such that the gasket G-1 is driven into and between the grooveway walls 117 and the apex tips 118 penetrate, slightly, the surface of the gasket G-1. Continued rotation in the locking direction of the lock-nut 113 is resisted by the inter-engagement of the taper 112 and shoulder 119 to effectively lock the lock-nut 113 in place.

As stated previously, it is not particularly necessary to incorporate use of a gasket G-1, but it is preferred.

When securement of the apparatus 100 in the sink S is completed, the drain line DL of known construction, is secured at threads 101A thereto.

When the apparatus 100 is in place in the sink S subsequent to affixation of the lock-nut 113 around the sleeve 101, the outer edge 106A of the top side 106 of the lip 105 is in substantial horizontal alignment with the bottom surface B of the sink. However, the top side 106 of the lip 105 is of inwardly sloping, or concave, configuration relative to the inner wall 104 of the sleeve 101 and the opening through the sleeve 101 such that fluid to be drained through the apparatus 100 in the sink B may be gravitationally urged toward and past the concave slope 110 of the curve 107 of the wall 104.

During draining, either the basket B or the filter disk 121 may be placed interiorally of the apparatus 100 to prevent inadvertent disposal of contaminating solids, or of material which has been inadvertently deposited in the sink S. Of course, the configuration of the profile 122 will permit the combined incorporation of the basket B and the filter disk 121.

When the filter disk 121 is in place, draining fluid passing through the passageways 123 will assist in abating chattering movements of the disk 121 along the profile 122 to stabilize the positioning of the disk 121 within the apparatus 100. The filter disk 121 may be removed at any time by placing a human finger, rod, pencil end or the like into one of the passageways 123, and "popping" the filter disk 121 out of position within the profile 122.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An outlet assembly for securement into a receiving profile defined upon the bottom surface of a sink for laboratory or like usage, comprising:

(1) an elongated cylindrical sleeve having upper and lower ends and further including a continuous inner wall extending therethrough from approximate the upper end to the lower end; and (2) a lip with top and bottom sides on the upper end of said sleeve and projecting outwardly from and radially around said upper end of said sleeve, the top side of said lip defining a smooth surface having an outer edge in substantial horizontal alignment with the bottom surface of said sink when said outlet assembly is secured within said sink, the top side of said smooth upper surface including an inwardly curved portion extending through the upper end of said sleeve and providing a part of the continuous inner wall within said cylindrical sleeve, said smooth upper surface of the top side of said lip sloping concavely from said outer edge through the inwardly curved portion, whereby liquid deposited immediate the outlet assembly and on the smooth upper surface of said top side may be gravitationally urged into the upper end of said sleeve, said sleeve being provided with threads for inter-engagement with companion threads on a lock-nut positionable around said sleeve for securing said assembly to said sink, said lock-nut including a series of circular grooveways extending between companion upperwardly projecting walls, each of said walls having an apex tip formed on the outermost surface thereof and sloping outwardly and downwardly therefrom to the respective grooveway, and further comprising sealing means disposed around the exterior of the sleeve, said grooveways and said projecting walls being immeshable relative to said sealing means upon securement of said assembly into said sink.

2. An outlet assembly for securement into a receiving profile defined upon the bottom surface of a sink for laboratory or like usage, comprising:

(1) an elongated cylindrical sleeve having upper and lower ends and further including a continuous inner wall extending therethrough from approximate the upper end to the lower end; and (2) a lip with top and bottom sides on the upper end of said sleeve and projecting outwardly from and radially around said upper end of said sleeve, the top side of said lip defining a smooth surface having an outer edge in substantial horizontal alignment with the bottom surface of said sink when said outlet assembly is secured within said sink, the top side of said smooth upper surface including an inwardly curved portion extending through the upper end of said sleeve and providing a part of the continuous inner wall within said cylindrical sleeve, said smooth upper surface of the top side of said lip sloping concavely from said outer edge through the inwardly curved portion, whereby liquid deposited immediate the outlet assembly and on the smooth upper surface of said top side may be gravitationally urged into the upper end of said sleeve, the bottom side of said lip including a taper therearound extending exteriorally around the upper end of said sleeve for center alignment of said assembly into said receiving profile, the exterior of said sleeve being provided with threads for inter-engagement with companion threads on a lock-nut positionable around said sleeve for securing said assembly to said sink, said lock-nut including a series of circular grooveways extending between companion upperwardly projecting walls, each of said walls having an apex tip formed on the outermost surface thereof and sloping outwardly and downwardly therefrom to the respective grooveway, and further comprising sealing means disposed around the exterior of the sleeve, said grooveways and said projecting walls being immeshable relative to said sealing means upon securement of said assembly into said sink.

3. The assembly of claim 1 or claim 2 wherein said lock-nut includes an outwardly extending interiorally defined circumferentially extending shoulder on one side of one of said projecting walls for engagement with said taper to thereby lock said lock-nut onto said sleeve in resistance to movements therebetween in one direction.

* * * * *